US009522302B2

(12) United States Patent
Herring

(10) Patent No.: US 9,522,302 B2
(45) Date of Patent: Dec. 20, 2016

(54) FLIPPER DEVICE AND METHODS FOR USING SAME

(71) Applicant: Paul M. Herring, Mt. Pleasant, SC (US)

(72) Inventor: Paul M. Herring, Mt. Pleasant, SC (US)

( * ) Notice: Subject to any disclaimer, the term of this patent is extended or adjusted under 35 U.S.C. 154(b) by 0 days.

(21) Appl. No.: 14/625,880

(22) Filed: Feb. 19, 2015

(65) Prior Publication Data

US 2016/0243405 A1 Aug. 25, 2016

(51) Int. Cl.
*A63B 31/11* (2006.01)

(52) U.S. Cl.
CPC ..... *A63B 31/11* (2013.01); *A63B 2031/112* (2013.01); *A63B 2209/08* (2013.01); *A63B 2209/10* (2013.01); *A63B 2210/50* (2013.01)

(58) Field of Classification Search
CPC ..... A63B 31/11; A63B 2031/112
USPC ..... 441/63–64
See application file for complete search history.

(56) References Cited

U.S. PATENT DOCUMENTS 5,108,327 A * 4/1992 Klein ..... A63B 31/11 441/62
5,924,902 A * 7/1999 Burns ..... A63B 31/11 441/64
6,120,336 A * 9/2000 Kawai ..... A63B 31/11 441/62
6,155,898 A 12/2000 Burns et al.
6,227,923 B1 * 5/2001 Johnson ..... A63B 31/11 441/61
6,247,982 B1 6/2001 Walker
6,672,920 B2 * 1/2004 Wilson ..... A63B 31/11 441/64
6,702,633 B1 * 3/2004 Johnson ..... A63B 31/11 441/64
7,159,336 B2 * 1/2007 Burns ..... A63B 31/11 36/8.1
8,641,464 B2 * 2/2014 Ortwig ..... A63B 31/11 441/64
8,986,061 B2 * 3/2015 Fraser ..... A63B 31/11 441/64
2002/0028618 A1 3/2002 Hashizume et al.
(Continued)

FOREIGN PATENT DOCUMENTS

DE 4020235 1/1992
WO 2007138367 12/2007

OTHER PUBLICATIONS

Website. "www.flipfins.com/index.php?page=about". Accessed Sep. 21, 2015. 2 pages.

(Continued)

*Primary Examiner* — S. Joseph Morano
*Assistant Examiner* — Jovon Hayes
(74) *Attorney, Agent, or Firm* — K&L Gates LLP

(57) ABSTRACT

A flipper device that provides a swimmer with functional use of the flipper when fully assembled, and easy, convenient use of same when the swimmer desires to walk in the flipper. In embodiment, the flipper device includes a boot and a fin that is at least partially collapsible, removable from the boot, stored in a substantially vertical orientation on the boot, and secured in its substantially vertical orientation by a securing component. The boot includes a first portion of a fastener, and the securing component. The fin includes a second portion of the fastener that is capable of engaging the first portion of the fastener to removably attach the fin to the boot.

24 Claims, 6 Drawing Sheets

FIG. 1

(56) References Cited

U.S. PATENT DOCUMENTS

2013/0059492 A1* 3/2013 Ortwig ..... A43B 5/08
441/64

OTHER PUBLICATIONS

Website. "www.flipfins.com/index.php?page=fins". Accessed Sep. 21, 2015. 1 page.
Website. "www.flipfins.com/index.php?page=fins &product=classic". Accessed Sep. 21, 2015. 2 pages.
Website. "www.flipfins.com/index.php?page=productss &product=navigator". Accessed Sep. 21, 2015. 2 pages.
Website. "www.flipfins.com/index.php?page=products &product=stealth". Accessed Sep. 21, 2015. 2 pages.
Website. "www.flipfins.com/index.php?page=products &product=stealthmax". Accessed Sep. 21, 2015. 2 pages.
Search Report for related International Patent Application No. PCT/US2016/018277 mailed Apr. 25, 2016. 5 pages.
Written Opinion for related International Patent Application No. PCT/US2016/018277 mailed Apr. 25, 2016. 3 pages.

* cited by examiner

FLIPPER DEVICE AND METHODS FOR USING SAME

BACKGROUND

The present disclosure relates generally to a device for aiding in navigation through water. More specifically, the present disclosure relates to flipper devices having a boot and a fin and that are convenient and easy to use both in and out of the water. Additionally, the present disclosure relates to methods of using such flipper devices.

Swimming flippers are known devices that have long been used to aid a swimmer in moving more efficiently through the water. Such assistance may be necessary because human feet provide relatively poor thrust when swimming in water. Movement may further be hindered if the swimmer is, for example, a scuba diver or snorkeler who is carrying equipment that increases hydrodynamic drag. Alternatively, such assistance may also be necessary when the swimmer is, for example, a freediver who requires assistance in underwater propulsion that does not require high frequency leg movement, and that helps to minimize oxygen consumption. Additionally, swimming flippers may also be used by individuals who partake in various water activities including, for example, kneeboarding, water rugby, bodyboarding, etc.

Swimming flippers are worn on the foot or leg of the swimmer and simple constructions are generally made from a rubber or plastic material. More advanced constructions, however, typically comprise both a boot that is worn like a shoe by the swimmer, and a fin that has a blade or web construction. The fin may be either permanently or removably fixed to the boot. The fin of the flipper increases the amount of water displaced during kicking, thereby increasing the propulsion of the swimmer in the water.

Due to the functional requirements of the flipper, it must be of sturdy construction to withstand the large amounts of force that a top side of the flipper will encounter during a downward stroke of the flipper during a kicking movement. Such a sturdy and rigid construction, however, can make it difficult and extremely cumbersome to manipulate the flipper when the swimmer desires to walk on land. In this situation, the swimmer would be required to either walk awkwardly in the flipper, or to remove the flipper entirely, which includes removing the boot of the flipper as well as the fin. Accordingly, it would be beneficial for a swimmer to have a flipper that not only provides for adequate propulsion during use, but that is also convenient and easy to walk in when the swimmer is out of the water.

SUMMARY

The present disclosure is directed to a flipper having a boot to which a removable fin portion is attached. The fin may be either fully removable, or may have a portion that is removable, from the boot. For example, the fin may be fully removed from a toe portion of the boot and stored on a portion of the boot. Alternatively, a portion of the fin may be removed from the boot while a portion of the fin may remain connected to the boot for easy storage of the fin portion on the boot. Such configuration will provide a swimmer with functional use of the flipper when fully assembled, but will also provide the swimmer with easy, convenient use of same when the swimmer desires to walk on a solid surface.

Accordingly, in a general embodiment, the present disclosure provides a flipper having a removable fin. The flipper device includes a boot having a first portion of a fastener and a securing component; and a fin that includes a second portion of the fastener, which is capable of engaging the first portion of the fastener to removably attach the fin to the boot. The fin is so constructed and arranged to be at least partially collapsible, removable from the boot, stored in a substantially vertical orientation on the boot, and secured in its substantially vertical orientation by the securing component.

In an embodiment, the fastener is selected from the group consisting of a zipper, buttons, snaps, magnets, straps, velcro, a ratchet device, or combinations thereof.

In an embodiment, the securing component is selected from the group consisting of a button, a snap, a magnet, straps, a u-shaped component, velcro, a snap-fit component, a hook, a buckle, or combinations thereof.

In an embodiment, the flipper device further includes a tether that is removably attached to one of a top of the boot and a top of the fin.

In an embodiment, the flipper device further includes a tether that is permanently attached to one of the top of the boot and the top of the fin.

In an embodiment, the boot further includes a sole on a bottom of the boot and the second portion of the fastener comprising a channel formed in the sole such that the sole of the boot is substantially flat.

In an embodiment, the first portion of the fastener includes a channel and the second portion of the fastener comprises a bar component that slideably engages the channel.

In an embodiment, the fastener includes a gripping element that is selected from the group consisting of a tether, a string, a ribbon, a loop of material, or combinations thereof.

In yet another embodiment, a flipper device includes a boot having a leg portion, a toe portion, a hinge mechanism, and a securing component. The flipper device further includes a fin that is removably attachable to the toe portion and includes a connector for connecting to the hinge mechanism. The fin is so constructed and arranged to be at least partially collapsible, pivotable by the hinge mechanism, stored in a substantially vertical orientation along the leg portion, and secured in its vertical orientation by the securing component.

In an embodiment, the hinge mechanism includes a rod that is connected to the fin on a first end of the rod.

In an embodiment, the hinge mechanism is so constructed and arranged to pivot the fin from a substantially horizontal orientation to the substantially vertical orientation.

In an embodiment, the connector is selected from the group consisting of a hollow opening in a rigid portion of the fin, an adhesive, a strap, or combinations thereof.

In an embodiment, the securing component is selected from the group consisting of a button, a snap, a magnet, straps, a u-shaped component, velcro, a snap-fit component, a hook, a buckle, or combinations thereof.

In an embodiment, the flipper device further includes a tether that is removably attached to one of a top of the boot and a top of the fin.

In an embodiment, the flipper device further includes a tether that is permanently attached to one of the top of the boot and the top of the fin.

In still yet another embodiment, a method for using a flipper device is provided. The method includes providing a flipper device having a fin fastened to a boot having a toe portion and a leg portion; unfastening the fin from the toe portion of the boot; at least partially collapsing the fin; and storing the fin in a substantially vertical orientation along the leg portion of the boot.

In an embodiment, the method further includes re-fastening the fin to the toe portion of the boot when a user desires to use the flipper device in water.

In an embodiment, the at least partially collapsing is achieved by an action selected from the group consisting of folding, rolling, gathering, and combinations thereof.

In an embodiment, the method further includes securing the fin in its substantially vertical orientation using a securing component.

In an embodiment, the securing component is selected from the group consisting of a button, a snap, a magnet, straps, a u-shaped component, velcro, a snap-fit component, a hook, a buckle, or combinations thereof.

An advantage of the present disclosure is to provide an improved flipper device.

Another advantage of the present disclosure is to provide a flipper device having a fin that is removable from, and stored on, a boot.

Still another advantage of the present disclosure is to provide a flipper device that provides easy, convenient transitioning of a swimmer from water to land and vice versa.

An additional advantage of the present disclosure is to provide methods for using a flipper device having a fin that is at least partially removable from a boot.

Yet another advantage of the present disclosure is to provide methods for storing a fin of a flipper on a boot of the flipper for the convenience and comfort of a swimmer when walking on a solid surface.

Additional features and advantages are described in, and will be apparent from, the following Detailed Description and the Figures.

DETAILED DESCRIPTION

Figure 1:
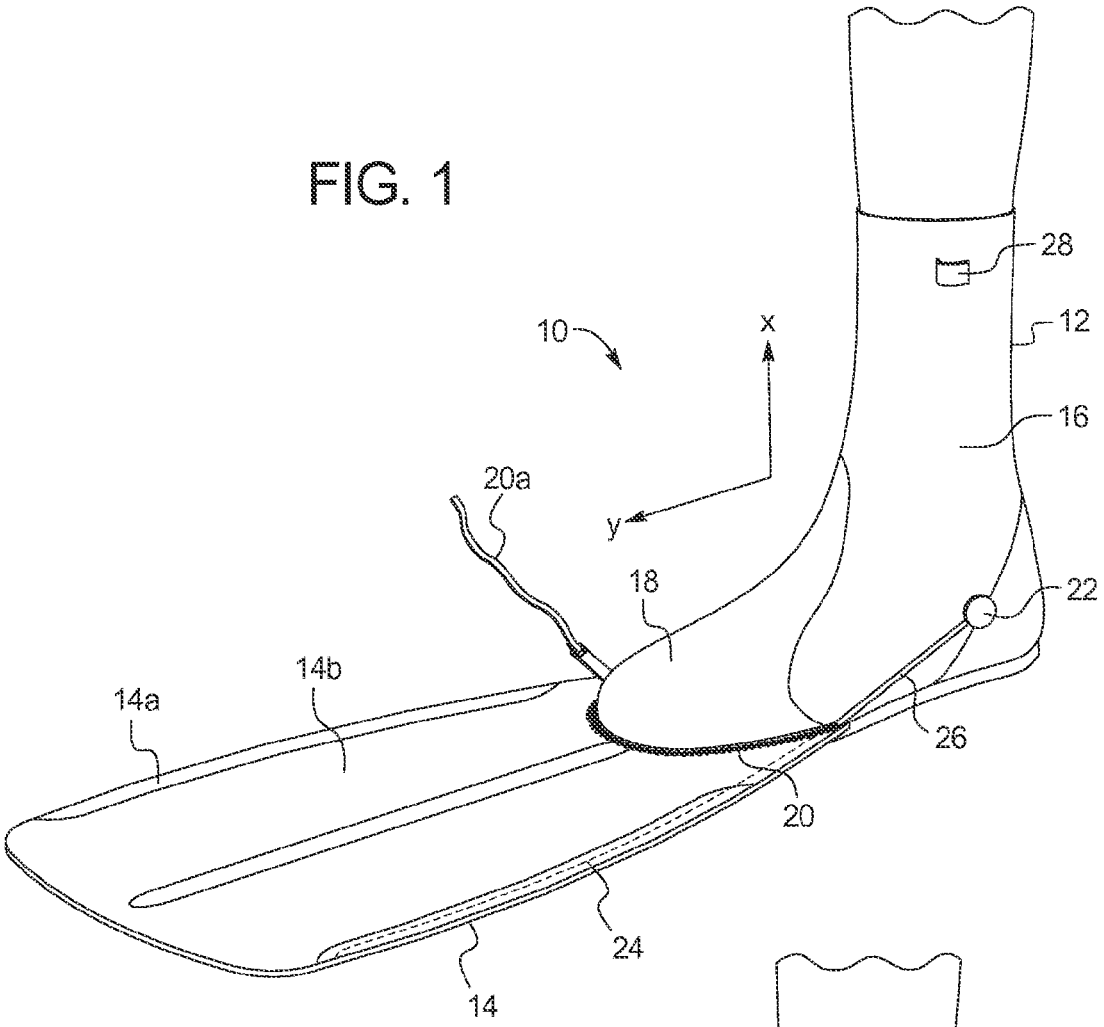
FIG. 1 illustrates a perspective view of a flipper device in accordance with an embodiment of the present disclosure.

As used herein and in the appended claims, the singular form of a word includes the plural, and vice versa, unless the context clearly dictates otherwise. Thus, the references "a," "an" and "the" are generally inclusive of the plurals of the respective terms. For example, reference to "a hinge" or "a method" includes a plurality of such "hinges" or "methods." The term "and/or" used in the context of "X and/or Y" should be interpreted as "X," or "Y," or "X and Y."

As used herein, "about" is understood to refer to numbers in a range of numerals, for example the range of −10% to +10% of the referenced number, preferably −5% to +5% of the referenced number, more preferably −1% to +1% of the referenced number, most preferably −0.1% to +0.1% of the referenced number.

Similarly, the words "comprise," "comprises," and "comprising" are to be interpreted inclusively rather than exclusively. Likewise, the terms "include," "including" and "or" should all be construed to be inclusive, unless such a construction is clearly prohibited from the context. However, the embodiments provided by the present disclosure may lack any element that is not specifically disclosed herein. Thus, a disclosure of an embodiment defined using the term "comprising" is also a disclosure of embodiments "consisting essentially of" and "consisting of" the disclosed components. Where used herein, the term "example," particularly when followed by a listing of terms, is merely exemplary and illustrative, and should not be deemed to be exclusive or comprehensive. Any embodiment disclosed herein can be combined with any other embodiment disclosed herein unless explicitly indicated otherwise.

As discussed above, swimming flippers are known devices that have long been used to aid a swimmer in moving more efficiently through the water. Such assistance may be necessary because human feet provide relatively poor thrust when swimming in water. Movement may further be hindered if the swimmer is, for example, a scuba diver or snorkeler who is carrying equipment that increases hydrodynamic drag. Alternatively, such assistance may also be necessary when the swimmer is, for example, a freediver who requires assistance in underwater propulsion that does not require high frequency leg movement, and that helps to minimize oxygen consumption. Additionally, swimming flippers may also be used by individuals who partake in various water activities including, for example, kneeboarding, water rugby, bodyboarding, etc.

Swimming flippers are worn on the foot or leg of the swimmer and simple constructions are generally made from a rubber or plastic material. More advanced constructions, however, typically comprise both a boot that is worn like a shoe by the swimmer, and a fin that has a blade or web construction. The boot of a flipper is typically constructed of an elastic neoprene or a thermoplastic rubber. The fin is typically constructed of, for example, a thermoplastic material such as a thermoplastic rubber, a natural rubber, polypropylene, polyethylene, etc., and may be either permanently or removably fixed to the boot. The fin of the flipper increases the amount of water displaced during kicking, thereby increasing the propulsion of the swimmer in the water.

Due to the functional requirements of the flipper, it must be of sturdy construction to withstand the large amounts of force that a top side of the flipper with encounter during a downward stroke of the flipper during a kicking movement. Such a sturdy and rigid construction, however, can make it difficult and extremely cumbersome to manipulate when the swimmer desires to walk on a solid surface (e.g., land). In this situation, the swimmer would be required to either walk awkwardly in the flipper, or to remove the flipper entirely, which includes removing the boot of the flipper as well as the fin.

Applicant has developed a swimmer to have a flipper that not only provides for adequate propulsion during use, but that is also convenient and easy to walk in when the swimmer is out of the water. In this regard, the flipper includes both a boot portion and a fin portion. The fin may be either fully removable, or may have a portion that is removable, from the boot. For example, the fin may be fully removed from a toe portion of the boot and stored on a portion of the boot. Alternatively, a portion of the fin may be removed from the boot while a portion of the fin may remain connected to the boot for easy storage of the fin portion on the boot. Such configuration will provide a swimmer with functional use of the flipper when fully assembled, but will also provide the swimmer with easy, convenient use of same when the swimmer desires to walk on a solid surface (e.g., land).

As shown in FIG. 1, a flipper device 10 includes a boot 12 and a fin 14. Boot 12 may be made of any material typically used for objects intended to be immersed in water for extended periods of time. Since swimming flippers are typically worn by humans and used during swimming in water, it may be beneficial to manufacture boot 12 of materials specifically designed not only for extended periods of time in water, but also for insulation purposes to keep the feet of swimmers warm. For example, boot 12 may be manufactured of a neoprene material (e.g., neoprene polychloroprene) ranging in thickness from about 1 to about 8 mm, or from about 2 to about 6 mm, or from about 3 to about 5 mm. Boot thickness is proportional to how much heat insulation it provides and thus to how cold the water which the user can tolerate. A leg portion 16 of boot 12 refers to a part of boot 12 that would extend from an ankle and up the leg of a user. As shown in FIG. 1, leg portion 16 extends in a substantially vertical direction from an ankle of boot 12 to an opening of boot 12. As used herein, "vertical orientation" refers to an orientation of a body that is substantially parallel to direction "X" as illustrated in FIG. 1. Accordingly, leg portion 16 extends in a substantially vertical orientation. Leg portion 16 may have a zipper down one side or may be tightened with a velcro strap at the front. A toe portion 18 of boot 12 refers to a part of boot 12 that would extend from an ankle of boot 12 to the toes of a user. As used herein, "horizontal orientation" refers to an orientation of a body that is substantially parallel to direction "Y" as illustrated in FIG. 1. Accordingly, toe portion 18 extends in a substantially horizontal orientation.

Fin 14 may be manufactured from any known material that is capable of functioning as a working flipper and being reduced in size for storage when not being used in the water. Fin 14 may be manufacture from, for example, deformable plastic materials. In an embodiment, fin 14 may include at least one rigid portion 14*a* and a webbing portion 14*b* connected to rigid portion 14*a*. In this construction, rigid portion 14*a* provides structure and rigidity to fin portion 14, while webbing portion 14*b* provides increased surface area to aid in propulsion of the swimmer. Although depicted in FIG. 1 as having three rigid portions 14*a*, the skilled artisan will appreciate that fin 14 need not have three rigid portions 14*a* and may have more or less. Webbing portion 14*b* may be, for example a relatively thin sheet of material that is manufactured from, but not limited to, a flexible and/or collapsable material such as nylon cloth, dacron, plastic film, or any other material having a low coefficient of friction or "drag" in water. Webbing portion 14*b* may be attached to rigid portion 14*a* by adhereing, sewing, lacing, or similar means.

Fin 14 may be removably attached to boot 12 by any fastener 20 capable of withstanding propulsion forces encountered during a kicking movement by a swimmer in water. As shown in FIG. 1, fin 14 may be attached to boot 12 by a large zipper 20 extending from a location corresponding, approximately, to the head of the fifth metatarsal in the foot, around the toe box of a user, to a location corresponding, approximately to the head of the first metatarsal. While fastener 20 is depicted in the present figures as a large zipper, the skilled artisan will understand that fastener 20 may be any other acceptable fastener such as, for example, buttons, snaps, buckles, magnets, velcro, etc.

In an embodiment, fastener 20 may also include a gripping element 20*a* to allow the user to quickly and easily grasp fastener 20 to connect fin 14 to boot 12 via fastener 20. Gripping element 20*a* may be, for example, a tether, string, ribbon, loop of material, etc., and may be from about 2 inches to about 6 inches in length, or from about 3 inches to about 5 inches in length or about 4 inches in length. The skilled artisan would immediately appreciate that gripping element 20*a* should be of sufficient length that grasping it to dis/connect fin 14 from/to boot 12 would be convenient for the user. For example, if the user is a swimmer who is swimming in a large body of water (e.g., pool, lake, ocean, etc.) and desires to disconnect fin 14 from boot 12 while in the water, the user may reach down and grasp gripping element 20*a* instead of, for example, the slider of a zipper. Accordingly, it will be much easier for the user to grasp and pull gripping element 20*a* for a quick and easy disconnection.

As mentioned previously, fin 14 may be fully removed from boot 12, or partially removed from boot 12, and then stored at some location on boot 12. As shown in FIG. 1, fin 14 may be unzipped from boot 12, collapsed in size, and then pivoted about a hinge 22. In this embodiment, rigid portion 14*a* of fin 14 may include a hollow channel 24 within which a long, thin element 26 is housed. Element 26 may be, for example, a rod, a stick, a pole, or the like that is made of wood, metal or any other material that is sufficiently rigid to allow fin 14 to be collapsed around it and pivoted upward about hinge 22.

Figure 2:
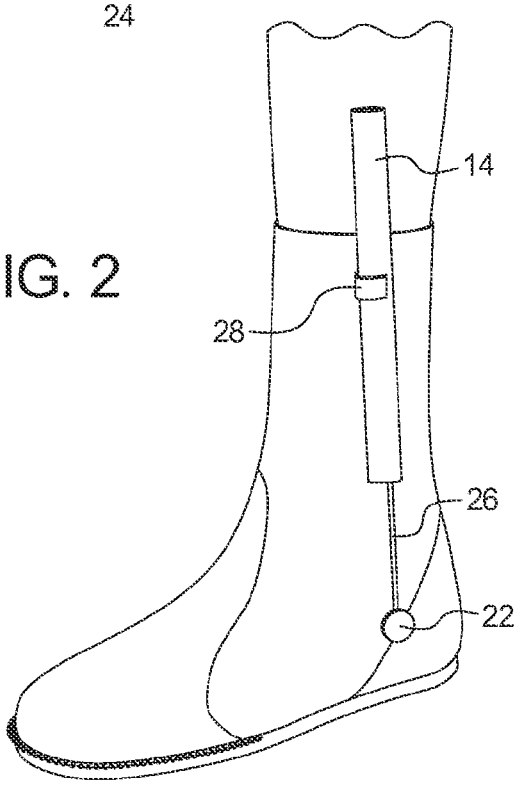
FIG. 2 illustrates a perspective view of a flipper device in accordance with an embodiment of the present disclosure.

When collapsed and pivoted upward, fin 14 may be stored in a substantially vertical position along the leg of a user, as shown in FIG. 2. If necessary, fin 14 may be secured in the vertical position by a securing component 28 on boot 12. Securing component 28 may be a stand-alone component that secures fin 14 without any connection to fin 14 such as, for example, a snap-fit component, a u-shaped element, a hook, or the like. Alternatively, securing component 28 may cooperate with a securing element (not shown) found on the collapsed fin 14. In this regard, securing component 28 and securing element may be velcro, snaps, buttons, magnets, etc., as will be discussed further below.

Figure 3:
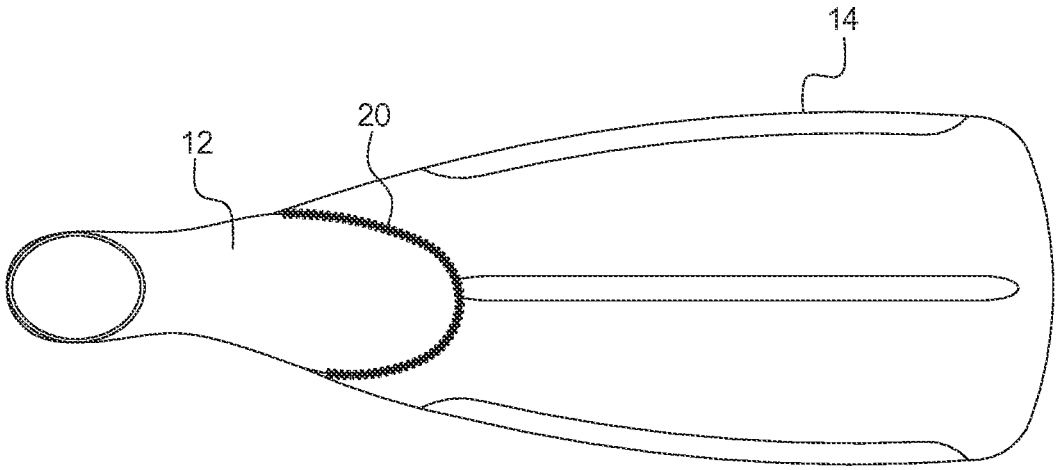
FIG. 3 illustrates a top view of a flipper device in accordance with an embodiment of the present disclosure.

When reference is made to fin 14 being "collapsed," it is meant that fin 14 may be reduced in size compared to its fully expanded configuration wherein fin 14 is ready for use. For example, FIG. 3 illustrates flipper 10 having fin 14 fully expanded and attached to boot 12. In this configuration, flipper 10 is ready for use by a swimmer. However, when fin 14 is either fully or partially separated from boot 12 such that fastener 20 no longer fully connects fin 14 and boot 12, fin 14 may be reduced in size by, for example, folding, gathering, or rolling fin 14.

Figure 4:
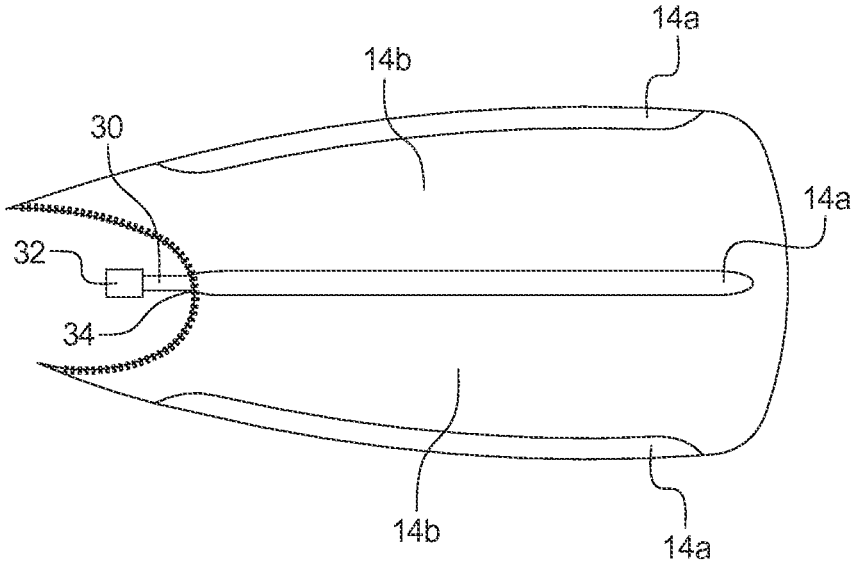
FIG. 4 illustrates a top view of a fin of a flipper device in accordance with an embodiment of the present disclosure.

In an alternative embodiment, fin 14 may be reduced in size by a collapsing mechanism 30 that includes an activation element 32, the mechanism located at a side of fin 14 that is connected to boot 12 when flipper 10 is configured for use. In this regard, collapsing mechanism 30 may be used to expand fin 14 by, for example, pressing a button 32, which releases a rider that moves away from collapsing mechanism 30 toward fin 14, thereby expanding, in a longitudinal direction, several series of rigid rods that are hingedly connected to each other. The series of rigid rods may be located in rigid portions 14*a* of fin 14, which are hollow in this embodiment. For example, if fin 14 includes three rigid portions 14*a*, such as is illustrated in FIG. 4, then collapsing mechanism 30 may include three series of rigid rods, one series for each rigid portion 14*a*, wherein the rigid rods are hingedly connected such that expansion of each series results in three, separate shafts that provide structure and rigidity to fin 14. When it is desired to collapse fin 14, the user may activate a release element 34 that releases the hinges and collapses the series of rigid rods so that fin 14 may be collapsed in a longitudinal direction.

Figure 5:
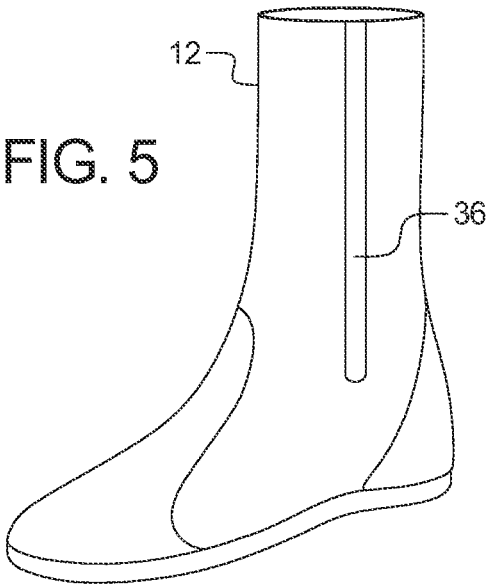
FIG. 5 illustrates a perspective view of a boot of a flipper device in accordance with an embodiment of the present disclosure.

In additional embodiments, and as mentioned above, boot 12 may include alternative elements for storing fin 14 thereon. For example, boot 12 in FIG. 5 includes a strip of velcro 36 that corresponds to another strip of velcro (not shown) that is located on fin 14. When fin 14 is at least partially removed from a toe portion of boot 12 and collapsed in size, fin 14 may be attached to boot 12 using velcro 36.

Figure 6:
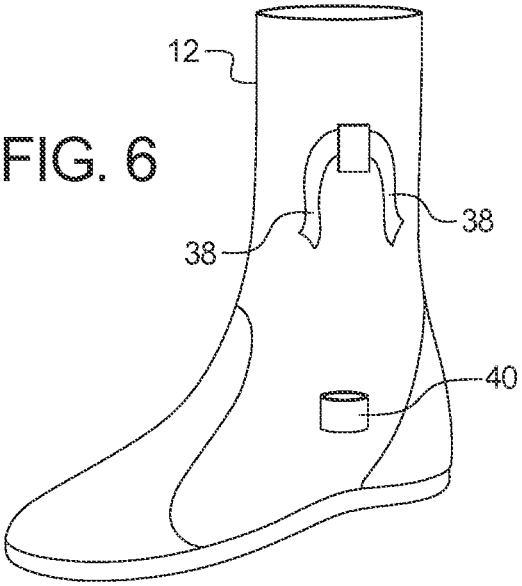
FIG. 6 illustrates a perspective view of a boot of a flipper device in accordance with an embodiment of the present disclosure.
Figure 7:
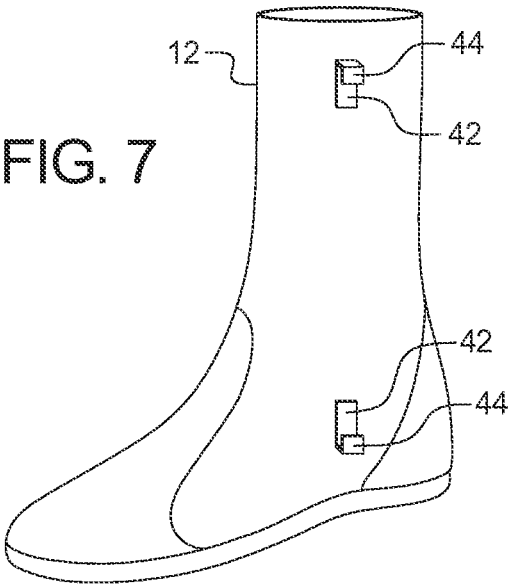
FIG. 7 illustrates a perspective view of a boot of a flipper device in accordance with an embodiment of the present disclosure.

Alternatively, and as shown in FIG. 6, boot 12 may include straps 38 that may be used to tie collapsed fin 14 to boot 12. In other words, when fin 14 is at least partially removed from a toe portion of boot 12 and collapsed in size, fin 14 may be tied to boot 12 using straps 38. In this embodiment, boot 12 may also include a substantially cup-shaped component 40 for additional storage support. In such an embodiment, when fin 14 is collapsed, an end of collapsed fin 14 may be placed within cup-shaped component 40, while another part of collapsed fin 14 may be tied to boot 12 using straps 38.

In still yet another embodiment, boot 12 may include a snap-fit mechanism 42 for securing fin 14 to boot 12. For example, snap-fit 42 mechanism 42 may include two components each having a tab portion 44 that is designed to snap-fit with a corresponding tab portion (not shown) located on collapsed fin 14. Providing various methods of storing fin 14 on boot 12 offers easy, convenient ways to carry fin 14 with the user when the user is no longer in need of the fully assembled flipper 10 (i.e., when the user is out of the water and desires to walk in boot 12). In this manner, fin 14 remains with the user, but the user is not required to carry fin 14 with his or her hands.

Figure 8:
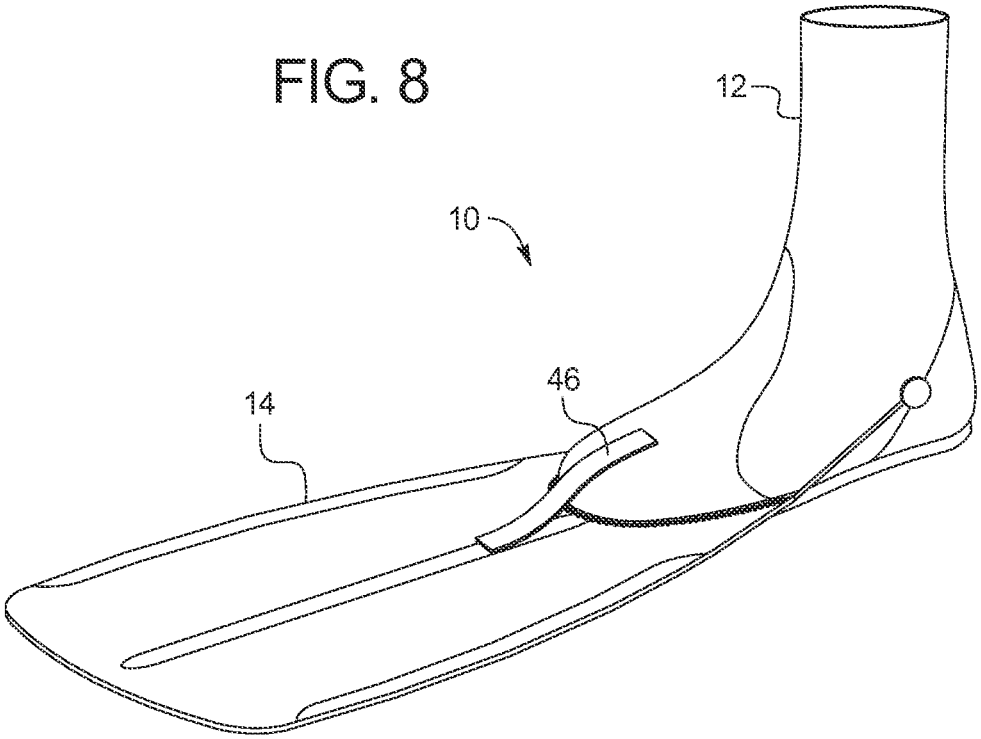
FIG. 8 illustrates a perspective view of a flipper device in accordance with an embodiment of the present disclosure.

As shown in FIG. 8, flipper 10 may include a tether 46 to ensure stability of flipper 10 during a downward kicking movement of the user in the water. Tether 46 may be, for example, a strap, a cord, a metal band, or the like and is either removably or permanently attached to one or both of fin 14 and boot 12 when flipper 10 is assembled for use. Tether 46 may be removably attached to fin 14 and/or boot 12 using snaps, buttons, magnets, velcro, a ratchet mechanism, or the like, so long as tether 46 is able to remain connected to both fin 14 and boot 12 during a downward kicking movement of the user in water.

Figure 9:
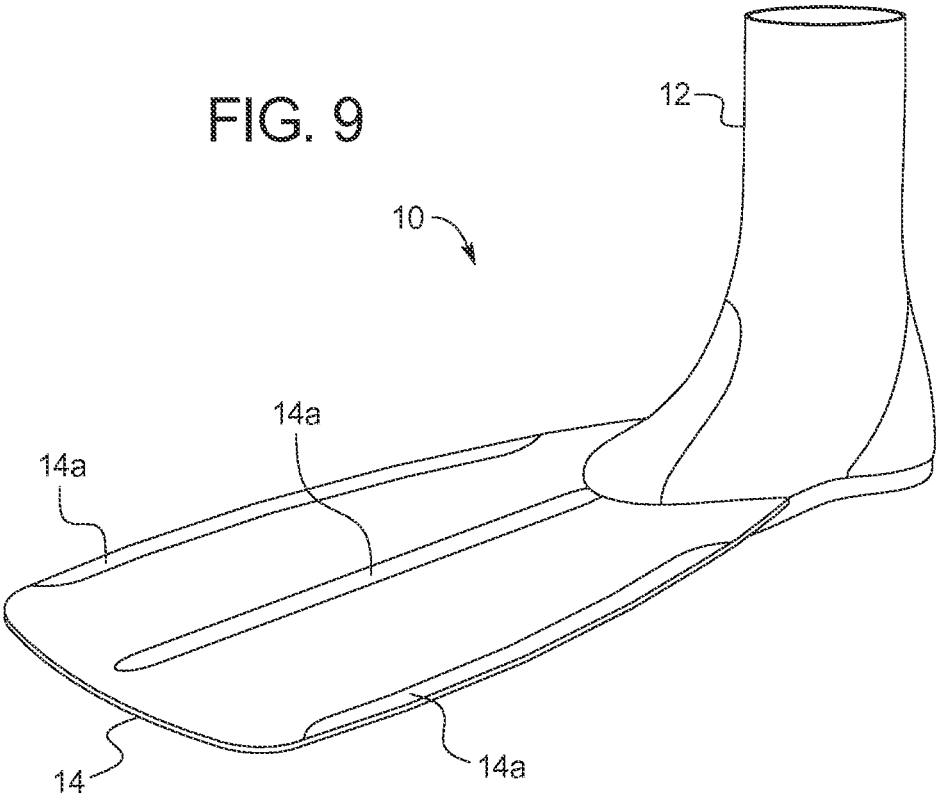
FIG. 9 illustrates a perspective view of a flipper device in accordance with an embodiment of the present disclosure.
Figure 10:
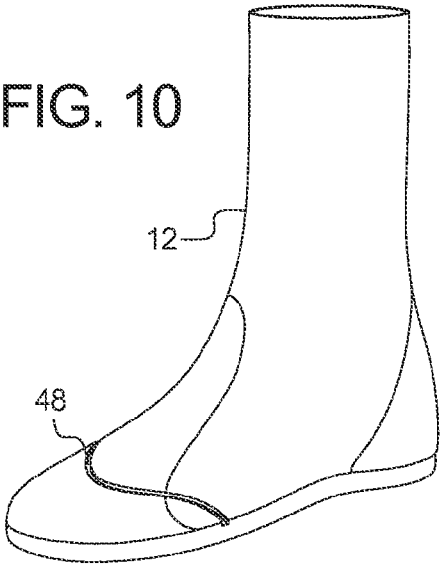
FIG. 10 illustrates a perspective view of a boot of a flipper device in accordance with an embodiment of the present disclosure.
Figure 11:
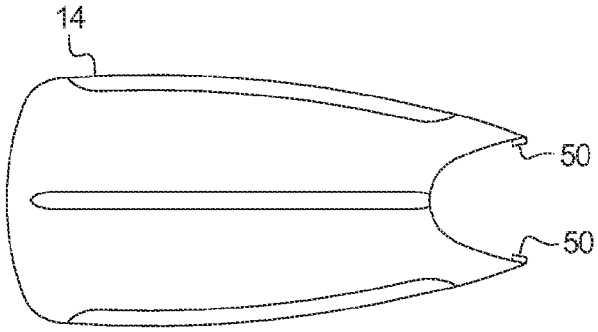
FIG. 11 illustrates a perspective view of a fin of a flipper device in accordance with an embodiment of the present disclosure.
Figure 12:
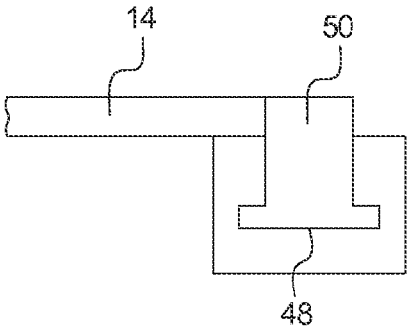
FIG. 12 illustrates a the engagement of a channel and bar component of a flipper device in accordance with an embodiment of the present disclosure.
Figure 13:
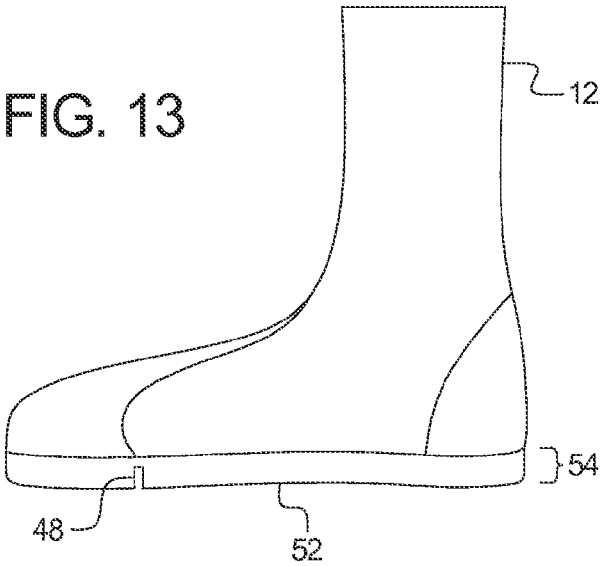
FIG. 13 illustrates a side view of a boot of a flipper device in accordance with an embodiment of the present disclosure.

In another embodiment, FIG. 9 illustrates a flipper 10 including a boot 12 and a fin 14. In this embodiment, fin 14 is attached to boot 12 by slideably engaging into channel 48 (FIG. 10) of boot 12 a correspondingly shaped bar component 50 (see FIG. 11). Channel 48 is formed into a substantially C-shaped piece of material that has sufficient rigidity so as to be able to maintain a hold of bar component 50 when flipper 10 is exposed to forces during use. In this regard, channel 48 may be formed by a sufficiently rigid plastic or metal material. To connect fin 14 to boot 12, bar component 50 is mated with channel 48 at one side of boot 12, slid along a curve of channel 48, and locked into place on an opposite side of boot 12. FIG. 12 illustrates an example of how channel 48 and bar component 50 may be mated for slideable engagement. In this embodiment, fin 14 may collapse or expand in a fan-like manner to attach or be removed from boot 12. Although the figures depict just one bar component 50, the skilled artisan will appreciate that fin 14 may include a plurality of bar components 50, which aid in stabilizing the connection of fin 14 to boot 12. In this regard, fin 14 may include, for example, 1, 2, 3, 4, 5, 6, 7, 8, 9, 10, or more bar components 50, so long as fin 14 is able to be collapsed in a fan-like manner.

In a variation of the embodiment disclosed in FIGS. 9-12, boot 12 may also include channel 48 on a bottom surface 52 of a sole 54 of boot 12. In this embodiment, boot 12 may include a sole 54 that is slightly thicker than a depth of channel 48 so as to provide a channel that is integrally formed in sole 54 for ease and comfort when walking in boot 12 on solid surfaces. In this embodiment, fin 14 would still include a bar component 50 that slideably engages channel 48 as described previously.

Figure 14:
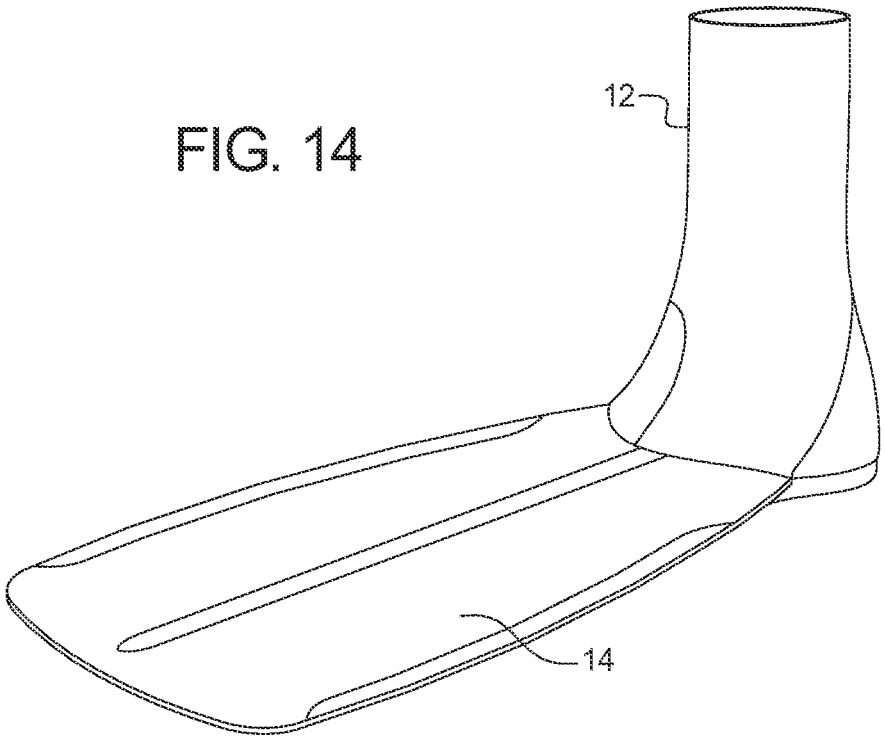
FIG. 14 illustrates a perspective view of a flipper device in accordance with an embodiment of the present disclosure.
Figure 15:
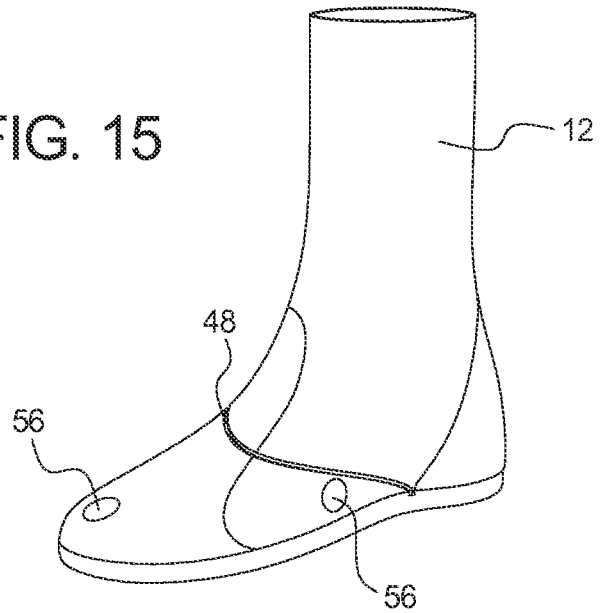
FIG. 15 illustrates a perspective view of a boot of a flipper device in accordance with an embodiment of the present disclosure.

FIGS. 14-15 illustrate yet another variation of the flipper devices described herein. As shown in FIG. 14, fin 14 may be attached to boot 12 by slideably engaging into a channel 48 (similar to that illustrated in FIG. 10) of boot 12 a correspondingly shaped bar component 50 (similar to that illustrated in FIG. 11). In this embodiment, however, channel 48 may be located at, or near, a front ankle portion of boot 12, instead of a location of boot 12 corresponding to a top of the user's toes, as in FIG. 9. Although FIG. 14 is described as using channel 48 and bar component 50 to fasten fin 14 to boot 12, the skilled artisan will appreciate that any of the fastening means discussed herein may be used (e.g., zipper, velcro, magnets, etc.).

As shown in FIG. 15, fin 14 may be further secured to boot 12 using at least one additional fastener 56, which may be a button, velcro, a magnet, a strap, a ratchet device, or the like. There may be any number of fasteners 56 to aid in attaching fin 14 to boot 12. For example, there may be a fastener 56 located at a toe portion of boot 12, at the right side ankle of boot 12, and at the left side ankle of boot 12.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A flipper device comprising:

a boot having a first portion of a fastener and a securing component; and a fin that includes a second portion of the fastener, which is capable of engaging the first portion of the fastener to removably attach the fin to the boot, wherein the fin is so constructed and arranged to be at least partially collapsible in size to a side of the boot and secured to the side of the boot by the securing component.

2. The flipper device of claim 1, wherein the fastener comprises at least one of a zipper, buttons, snaps, magnets, straps, a loop, or a ratchet device.

3. The flipper device of claim 1, wherein the securing component comprises at least one of a button, a snap, a magnet, straps, a u-shaped component, a snap-fit component, a hook, or a buckle.

4. The flipper device of claim 1, further comprising a tether that is removably attached to one of a top of the boot and a top of the fin.

5. The flipper device of claim 1, further comprising a tether that is permanently attached to one of a top of the boot and a top of the fin.

6. The flipper device of claim 1, the boot further comprising a sole on a bottom of the boot and the second portion of the fastener comprising a channel formed in the sole such that the sole of the boot is substantially flat.

7. The flipper device of claim 1, wherein the first portion of the fastener comprises a channel and the second portion of the fastener comprises a bar component that slideably engages the channel.

8. The flipper device of claim 1, wherein the fastener includes a gripping element comprising at least one of a tether, a string, a ribbon, or a loop of material.

9. A flipper device comprising:

a boot having a leg portion, a toe portion, a hinge mechanism, and a securing component; and a fin that is removably attachable to the toe portion and includes a connector for connecting to the hinge mechanism, wherein the fin is so constructed and arranged to be at least partially collapsible in size to a side of the boot, pivotable by the hinge mechanism, and secured to the side of the boot by the securing component.

10. The flipper device of claim 9, wherein the hinge mechanism includes a rod that is connected to the fin.

11. The flipper device of claim 9, wherein the hinge mechanism is so constructed and arranged to pivot the fin from a substantially horizontal orientation to a substantially vertical orientation.

12. The flipper device of claim 9, wherein the connector comprises at least one of a hollow opening in a rigid portion of the fin, an adhesive, or a strap.

13. The flipper device of claim 9, wherein the securing component comprises at least one of a button, a snap, a magnet, straps, a u-shaped component, a loop, a snap-fit component, a hook, or a buckle.

14. The flipper device of claim further comprising a tether that is removably attached to one of a top of the boot and a top of the fin.

15. The flipper device of claim further comprising a tether that is permanently attached to one of a top of the boot and a top of the fin.

16. A method for using a flipper device, the method comprising:

providing a flipper device comprising a fin fastened to a boot having a toe portion and a leg portion;

unfastening the fin from the toe portion of the boot;

at least partially collapsing the fin in size to a side of the boot; and storing the fin at the side of the boot along the leg portion of the boot.

17. The method of claim 16, further comprising re-fastening the fin to the toe portion of the boot when a user desires to use the flipper device.

18. The method of claim 16, wherein at least partially collapsing is achieved by at least one of folding, rolling, or gathering.

19. The method of claim 16, further comprising securing the fin in a substantially vertical orientation using a securing component.

20. The method of claim 19, wherein the securing component comprises at least one of a button, a snap, a magnet, straps, a u-shaped component, a snap-fit component, a hook, or a buckle.

21. The flipper device of claim 1, wherein the fin is so constructed and arranged to be secured in a substantially vertical orientation to the side of the boot by the securing component.

22. The flipper device of claim 9, wherein the fin is so constructed and arranged to be secured in a substantially vertical orientation to the side of the boot by the securing component.

23. A flipper device comprising:

a boot having a first portion of a fastener and a securing component;

a fin that includes a second portion of the fastener, which is capable of engaging the first portion of the fastener to removably attach the fin to the boot; and a tether that is removably or permanently attached to at least one of a top of the boot and a top of the fin, wherein the fin is so constructed and arranged to be at least partially collapsible, removable from the boot, stored in a substantially vertical orientation on the boot, and secured in the substantially vertical orientation by the securing component.

24. A flipper device comprising:

a boot having a leg portion, a toe portion, a hinge mechanism, and a securing component;

a fin that is removably attachable to the toe portion and includes a connector for connecting to the hinge mechanism; and a tether that is removably or permanently attached to at least one of a top of the boot and a top of the fin, wherein the fin is so constructed and arranged to be at least partially collapsible, pivotable by the hinge mechanism, stored in a substantially vertical orientation along the leg portion, and secured in the vertical orientation by the securing component.

* * * * *